US005087539A

United States Patent [19]

Takanashi et al.

[11] Patent Number: 5,087,539

[45] Date of Patent: Feb. 11, 1992

[54] METHOD AND APPARATUS FOR TRANSFERRING AN ELECTROSTATIC LATENT IMAGE

[75] Inventors: Itsuo Takanashi, Kamakura; Shintaro Nakagaki, Fujisawa; Hirohiko Shinonaga; Tsutou Asakura, both of Yokohama, all of Japan

[73] Assignee: Victor Company of Japan, Ltd., Yokohama, Japan

[21] Appl. No.: 385,862

[22] Filed: Jul. 27, 1989

[30] Foreign Application Priority Data

Jul. 28, 1988 [JP] Japan ..... 63-186947

[51] Int. Cl.[5] ..... G03G 13/18

[52] U.S. Cl. ..... 430/48; 430/60; 430/62

[58] Field of Search ..... 430/48, 60, 62, 66

[56] References Cited

U.S. PATENT DOCUMENTS

| | | | |
|---|---|---|---|
| 3,784,398 | 1/1974 | Metcalfe et al. | 430/48 |
| 3,980,475 | 9/1976 | Quang et al. | 430/48 |
| 4,056,390 | 11/1977 | Iizaka et al. | 430/48 |
| 4,286,032 | 8/1981 | Ito et al. | 430/55 |
| 4,410,614 | 10/1983 | Lelental et al. | 430/48 |

FOREIGN PATENT DOCUMENTS

| | | |
|---|---|---|
| 1937057 | 1/1970 | Fed. Rep. of Germany . |
| 2117264 | 4/1971 | Fed. Rep. of Germany . |

*Primary Examiner*—John Goodrow

*Attorney, Agent, or Firm*—Fleit, Jacobson, Cohn, Price, Holman & Stern

[57] ABSTRACT

A method for transferring an electrostatic latent image and apparatus therefor. This method comprises preparing a master recording member one side of which is provided with a first electrode and another side of which is provided with a first recording layer in which an image information is preformed in a form of material characteristic change of the first recording layer, preparing a blank recording member having a second recording layer, confronting the first recording layer of the master recording member with the second recording layer, and providing a uniform layer of charges to the second recording layer of the blank recording member by a charge providing member on a side of the second recording layer opposite to the side confronting the preformed image information, to produce a transferred electrostatic latent image on the second recording layer of the blank recording member corresponding with and in response to the image information preformed in the first recording layer of the master recording member.

25 Claims, 4 Drawing Sheets

METHOD AND APPARATUS FOR TRANSFERRING AN ELECTROSTATIC LATENT IMAGE

BACKGROUND OF THE INVENTION

This invention relates to a method and an apparatus for transferring an electrostatic latent image.

In the xerography method, the electrofax method, and the like which are known as typical methods of image formation method by an electrophotography, it is well known that there is employed a method of directly visualizing or developing an electrostatic latent image using a coloring toner. Further, in an electronic copy machine of the transfer type, it is well known that a method is employed to transfer the toner image onto a transfer sheet to thereby obtain a reproduction or a duplication of the original image.

However, in the electronic copy machines of the transfer type constructed employing such a transfer system to transfer, onto a transfer sheet, a toner image obtained by developing an electrostatic latent image by a coloring toner, respective processes of the charging process, the exposure process, the development process, the transfer process, and the cleaning process are repeatedly applied to a photosensitive drum constituted by using a photoconductor, resulting in a shortened lifetime of the photosensitive drum. To overcome this drawback, an attempt has been made to carry out a method for transferring an electrostatic latent image. Hitherto, various methods for transferring an electrostatic latent image have been proposed.

Meanwhile, in the conventional system for transferring an electrostatic latent image, an electrostatic latent image is transferred then developed by using a coloring toner, where an absolute value of the electrostatic potential of the transferred electrostatic latent image is unnecessary to be concerned.

However, in the high resolution image pickup device such as disclosed in the European Patent Application No. 89300633.8 filed by the applicant of the present application, it is dependent upon the absolute value of potential of an electrostatic latent image for reading out the electrostatic latent image as a video signal. In view of this, a method which can be readily put into practice has not been known in the art.

SUMMARY OF THE INVENTION

Therefore, an object of this invention is to provide a method and an apparatus for carrying out a non-destructive transfer of an electrostatic latent image, which is capable of clearly determining an absolute potential of an electrostatic latent image transferred.

In accordance with this invention, there is provided a method for transferring an electrostatic latent image, the method comprising steps of preparing a master recording member one side of which is provided with a first electrode and another side of which is provided with a first recording layer in which an image information is preformed in a form of material characteristic change of the first recording layer, preparing a blank recording member having a second recording layer, allowing the first recording layer of the master recording member confronting the second recording layer, and providing a uniform layer of charges to the second recording layer of the blank recording member by charge providing means on a side of the second recording layer opposite to the side confronting the preformed image information, to produce a transferred electrostatic latent image on the second recording layer of the blank recording member correspondingly with and in response to the image information preformed in the first recording layer of the master recording member.

For a change corresponding to the electrostatic latent image, a change in quantity of charges, a change in shape, and a change in conductivity, etc. may be utilized.

In accordance with a method for transferring an electrostatic latent image according to this invention, there is the least possibility that an electrostatic latent image formed on the recording member in correspondence with an optical image is destroyed or broken by transfer, and an absolute potential that an electrostatic latent image transferred is clearly determined or established. Moreover, since non-destructive transfer is conducted, a plurality of reproductions can be made. Further advantages are that a great deal of reproductions indispensable for package media such as video/audio equipment can be made, that spot reproduction of information can be easily conducted, and the like.

In accordance with this invention, there is also provided a system for transferring an electrostatic latent image from a master recording member to a blank recording member comprising:

a) a master recording member one side of which is provided with a first electrode and another side of which is provided with a first recording layer in which an image information is preformed in a form of material characteristic change of the first recording layer, b) a blank recording member having a second recording layer confronting said first recording layer of the master recording member, c) charge providing means for providing a uniform layer of charges to the second recording layer of the blank recording member on a side of the second recording layer opposite to the side confronting the preformed image information, to produce a transferred electrostatic latent image on the second recording layer of the blank recording member correspondingly with and in response to the image information preformed in the first recording layer of the master recording member.

DESCRIPTION OF THE PREFERRED EMBODIMENTS

Actual embodiments of a method for transferring an electrostatic latent image according to this invention will be described in detail with reference to the accompanying drawings.

Figure 1:
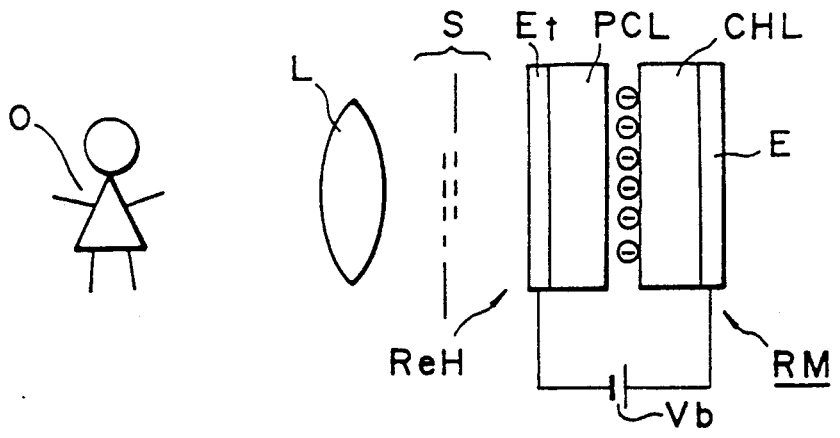
FIG. 1 is a schematic side view showing an outline of the arrangement of a recording system used in a method according to this invention.

FIG. 1 is a side view showing an outline of the arrangement of an embodiment of a recording system for forming an electrostatic latent image to be transferred, wherein the formed electrostatic latent image is used in a method for transferring an electrostatic latent image according to this invention. In FIG. 1, there is employed an arrangement such that an optical image of an object O which is subject to recording/reproducing can be formed, through an imaging lens S and a shutter L, on a recording member (recording medium) RM for recording an optical image of an object O as a charge image. The recording member RM is composed of an electrode E also serving as a base plate or substrate for the recording member, and a charge holding layer member CHL comprised of a highly insulative material. Moreover, a recording head ReH comprising a glass base plate BP (not shown), a transparent electrode Et, and a photoconductive layer member PCL is provided. A power supply Vb is connected between the transparent electrode Et in the recording head ReH and the electrode E in the recording member RM. Thus, an electric field having a predetermined intensity is formed between the transparent electrode Et in the recording head ReH and the electrode E in the recording member RM.

When the shutter S is opened, an optical image of object O is formed on the photoconductive layer member PCL in the recording head ReH by the imaging lens L. Since the electrical resistance value of the photoconductive layer member PCL in the recording head ReH varies in correspondence with the light intensity of an optical image of an object, an electrostatic latent image (charge image) corresponding to the optical image of object O is formed on the charge hold layer member CHL in the recording member RM.

Formation of an electrostatic latent image (charge image) corresponding to an optical image of object O onto the charge hold layer member CHL of the recording member RM may be satisfactorily carried out even under the condition where the photoconductive layer member PCL in the recording head ReH and the charge hold layer in the recording member RM are in tight contact with each other.

It is to be noted that the shutter S is used for setting a quantity of exposure, and that the recording member RM may take any form and dimensions, i.e., may be in the form of a disk, tape, sheet, card, or the like.

Figure 2:
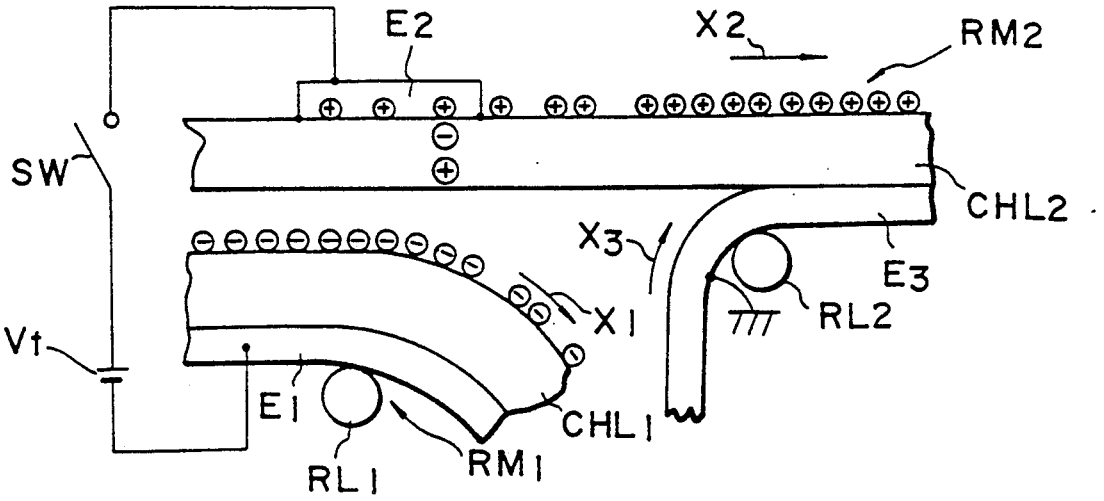
FIG. 2 is a model view showing an embodiment of a method for transferring an electrostatic latent image according to this invention.

FIG. 2 shows an embodiment of a method for transferring an electrostatic latent image according to this invention, which is adapted to non-destructive transfer to another recording member, i.e. the original electrostatic latent image is not lost or destroyed by the transfer of the image but is preserved, of an electrostatic latent image formed on the recording member RM by the recording system of the structure as shown in FIG. 1. In FIG. 2, RM1 is a first recording member used as a master for image transfer, which has a charge hold layer member CHL1 on which an electrostatic latent image is preformed thereon and an electrode E1 laminated to the charge held layer CHL 1. One surface of the charge hold layer member CHL1 in the first recording member RM1 and one surface of the charge hold layer member CHL2 in the second recording member RM2 to which an electrostatic latent image is to be transferred are closely disposed so that they are opposite to each other. The electrode E2 which is stationary in the direction X2 is in contact with the other surface of the second recording member RM2. A voltage is applied through a switch SW, from the power supply Vt, between the electrode E2 and the electrode E1 opposite thereto.

When an electric field corresponding to a charge distribution of an electrostatic latent image formed on the charge hold layer member CHL1 in the first recording member RM1, is applied to the charge hold layer member CHL2 in the second recording member RM2 at the portion which two electrodes E1 and E2 interpose, a polarization corresponding to the charge distribution of the electrostatic latent image is developed on the charge hold layer member CHL2 in the second recording member RM2.

The first recording member RM1 and the charge hold layer member CHL2 in the second recording member RM2 shown in FIG. 2 move incrementally while the electrode E2 is controlled to be out of contact with the charge hold layer member CHL 2 at the same movement speed in directions indicated by arrows X1 and X2, respectively. The first recording member RM1 is bent in a direction indicated by the arrow Xl by a roller RL1. When the charge hold layer member CHL2 in the second recording member RM2 is away from the area where the electrodes E1 and E2 are opposite, the electrostatic latent image formed on the charge hold layer member CHL1 in the recording member RM1 results a non-destructive transfer of the image onto the charge hold layer member CHL2 in the second recording member RM2.

A new electrode E3 is attached, through a roller RL2 to the surface opposite to the surface on which the transferred electrostatic latent image is formed. In FIG. 2, the arrow X3 represents a feeding direction of the new electrode E3.

Naturally after the attachment, this new electrode E3 moves unitarily with the charge hold layer member CHL2 of the second recording member RM2 moving in the direction indicated by the arrow X2. Accordingly, a scheme may be employed to read out an absolute potential of the electrostatic latent image transferred onto the second recording member RM2 by using a potential of the electrode E3 as a reference to generate an electrical signal such as video signals.

Figure 3:
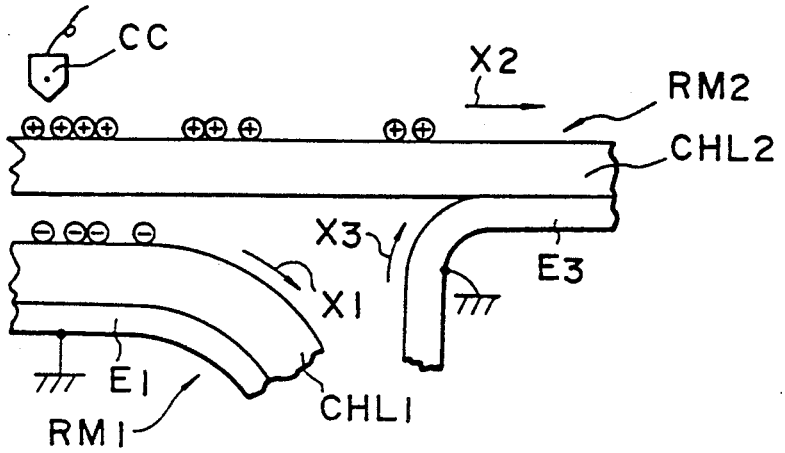
FIG. 3 is a model view showing an embodiment of a method for transferring an electrostatic latent image according to this invention based on a corona discharge.
Figure 4:
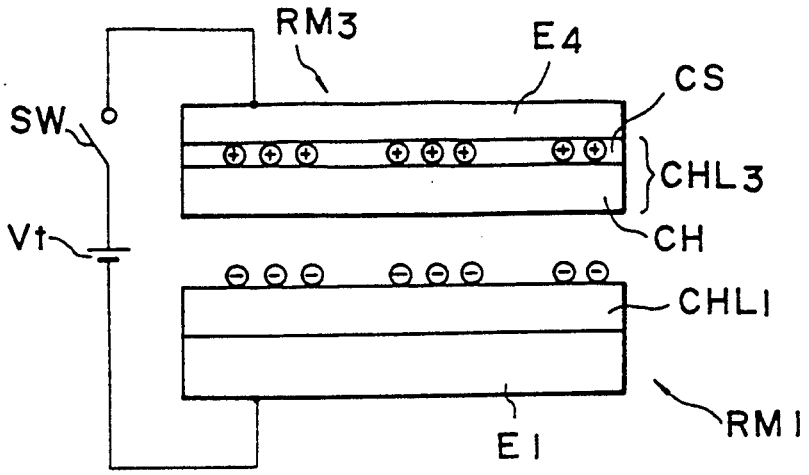
FIG. 4 is a model view showing another embodiment of a transfer method according to this invention.

FIG. 3 shows an arrangement for charging the recording member RM2 by corona discharge using a corona charger CC confronting the charge hold layer CHL2 at a side opposite to a side confronting the charge hold layer CHL1, the corona charge is used in place of the employment of the electrodes E2 and the power supply Vt in FIG. 2. By such an arrangement, the transfer may be made in the same manner as in FIG. 2. It is to be noted that electrode E2 and power supply Vt used in the case of FIG. 2 are unnecessary in the case of FIG. 3. Referring to FIG. 4, there is shown another embodiment of a method for transferring an electrostatic latent image according to this invention, in which an electrostatic latent image on the recording member RM formed by the recording system of the structure as shown in FIG. 1 is non-destructively transferred onto another recording member. In the arrangement shown in FIG. 4, RM1 is a first recording member having a charge hold layer member CHL1 on which an electrostatic latent image is already formed, and E1 is an electrode in the first recording member RM1.

Opposite to one surface of the charge hold layer member CHL1 in the first recording member RM1, is disposed one surface of the charge hold layer member CHL3 in another recording member RM3 to which an electrostatic latent image is to be transferred. An electrode E4 is laminated to the other surface of the recording member RM3. A voltage Vt is applied, through the switch SW, from the power supply Vt between the electrodes El and E4.

The charge hold layer member CHL3 in the recording member RM3 is formed as a laminated structure (e.g., a double layer structure) comprised of a layer CS having a tunnel effect (e.g. a silicon oxide film) permitting charges to pass therethrough when an applied electric field strength is higher than its threshold voltage, and a layer CH (e.g., a silicon nitride film) having a function of holding charges.

First, one surface of the charge hold layer member CHL1 in the first recording member RM1 and one surface of the charge hold layer member CHL3 in another recording member RM3 to which an electrostatic latent image is to be transferred are oppositely disposed. Then, a voltage Vt to be applied from the power supply Vt between the electrodes E1 and E4 is set to the threshold voltage.

As the potential of the electrode E4 with respect to the potential E1, is higher than the threshold voltage at the portions where negative charges exist on the charge hold layer member CHL1, the positive charges in the electrode E4 are attached by and moved toward the negative charges through the portions of the layer CS directly confronting the negative charges on the charge hold layer member CHL1. Thus, upon closing the switch Sw charges in the electrostatic latent image formed in the charge hold layer member CHL1 in the first recording member RM1 are passed through the layer CS in the charge hold layer member CHL3 by the tunnel effect. Then, they are captured at the boundary between the layer CS and the layer CH and held thereat.

Accordingly, an electrostatic latent image having a potential of the electrode E4 as a reference is formed on the charge hold layer member CHL3 of the recording member RM3 in FIG. 4. It is to be noted that erasing of charges captured and held at the boundary between layers CS and CH in the charge hold layer member CHL3 of the recording member RM3 may be carried out by irradiating ultraviolet rays, with an application of a voltage having a polarity opposite to that of the voltage which has been applied in transferring the electrostatic latent image, or by implementing similar methods.

Figure 5A:
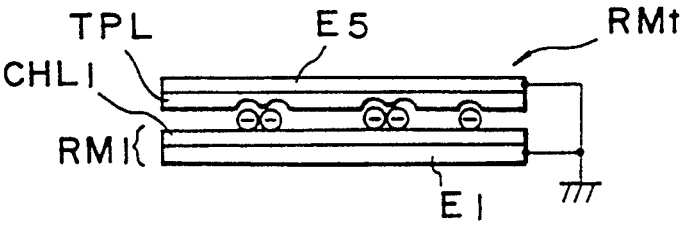
FIGS. 5A and 5B are explanatory views showing process steps of a further embodiment utilizing a change in shape or configuration by the transfer method according to this invention, respectively.
Figure 5B:
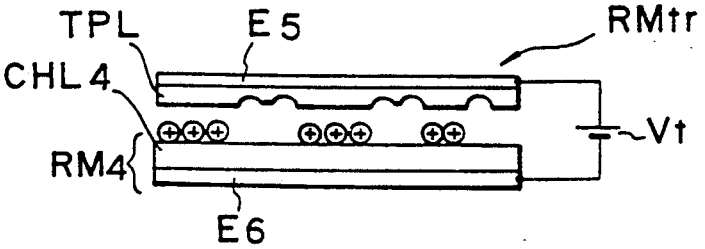

FIGS. 5A and 5B are explanatory views in the case of implementing another embodiment of a method for transferring an electrostatic latent image according to this invention. An electrostatic latent image of the recording member RM1 formed on the recording member by the recording system of the structure as shown in FIG. 1 is first transferred onto a recording member RMt provided with a recording layer TPL comprised of a kind of thermoplastic material known to the industry, of which the material deforms depended upon the applied heat and electric field, so that the electrostatic latent image is stored as a deformation (negative relief) produced on the surface of the recording layer TPL in the recording member RMt. Then using the recording member RM1 with the deformed recording layer TPL as a master, a copy of the electrostatic latent image is regenerated on a charge hold layer member CHL4 of a new recording member RM4 which is a blank recording member brought in place of the recording member RM1 as shown in FIG. 5B.

As shown in FIG. 5A, the first stage of this embodiment includes the steps of preparing the first recording member RM1 comprising the electrode E1 and the charge hold layer member CHL1, on which an electrostatic latent image is preformed; and preparing the second recording member RMt comprising electrode E5 and the recording layer TPL, then stacking the second recording member RMt on top of the first recording member RM1 so that the recording layer TPL of the second recording member RMt contact with the charge hold layer member CHL1 of the first recording member RM1; in turn, making the potentials of the respective electrodes E5 and E1 common to each other by connecting them with a wire for instance; then heat is applied to the stacked recording member RMt and RM1 to cause the recording layer TPL of the recording member RMt to produce a deformation corresponding to the electrostatic latent image on the charge hold layer member CHL1 of the first recording member RM1.

The recording member RMt prepared in the first stage is used as a master for transferring an electrostatic latent image as shown in FIG. 5B. The second stage of this embodiment includes the steps of: replacing the first recording member RM1 with a new blank recording member RM4 allowing the surface of the recorded recording layer TPL of the recording member RMtr where the deformed surface is opposite to the surface of the charge hold member CHL4 in the recording member RM4; applying a voltage Vt from the power supply Vt between an electrode E6 laminated to the recording member RM4 and the electrode E5 provided in the recorded recording member RMtr. The deformation on the recording layer TPL provides distance variations between the recording layer TPL and the charge hold layer member CHL4, this causes variations of electrical field strength between them and is responsible to form the new electrostatic latent image on the charge hold layer member CHL4 of the recording member RM4.

Accordingly, using the recording member RMtr as a master, it is possible to transfer electrostatic latent images in sequence onto a plurality of blank recording members in the manner as shown in FIG. 5B.

It is to be noted that when deformed recording layer TPL of thermoplastic is desired to be restored to an original unrecorded state, it is possible by heating the thermoplastic layer to a specified temperature for the thermoplastic material.

FIG. 6 is an explanatory view showing a still further embodiment for transferring an electrostatic latent image formed on the charge hold layer member CHL1 in the recording member RM1 by the recording system of a structure as shown in FIG. 1. As shown in this figure, a recording member RMsw is provided with an electrode E7 and a switching layer SWL having a conductivity varying depending upon an applied electric field. A charge pattern corresponding to an electrostatic latent image in the charge hold layer member CHL1 of the first recording member RM1 is first stored in the switching layer SWL in the recording member RMsw as a distribution pattern registering changes in resistance of the switching layer SWL in the recording member RMsw (distribution pattern assuming on and off states of the switch) (FIG. 6A).

There is a blank recording member RM4 of a laminated structure at least comprising a charge hold layer member CHL4 and an electrode E6. The charge hold layer member CHL4 of the recording member RM4 is uniformly charged using a corona charger CC (FIG. 6B).

Figure 6A:
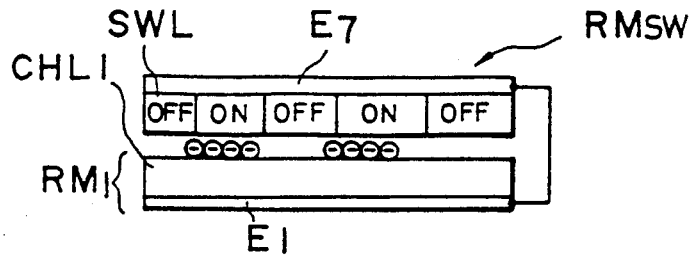
FIGS. 6A to 6D are explanatory views showing process steps of a still further embodiment utilizing a change in conductivity by the transfer method according to this invention, respectively.
Figure 6B:
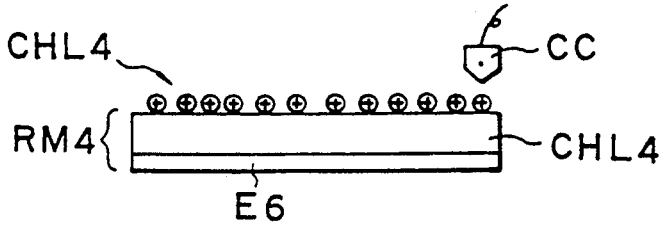
Figure 6C:
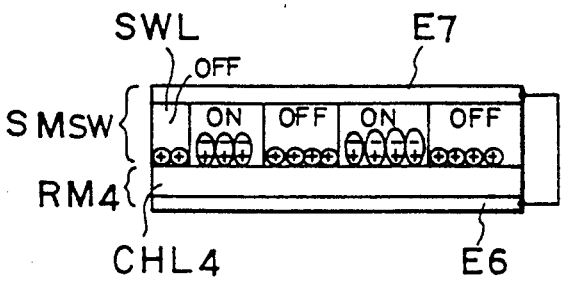
Figure 6D:
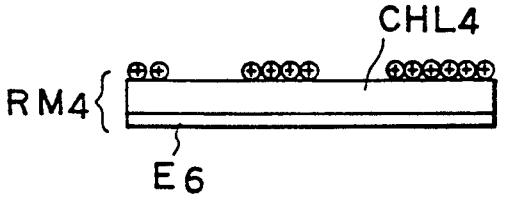

Then, by replacing the first recording member RM1 in the arrangement shown in FIG. 6A, with a blank recorrding member RM4 having the surface of the charge hold layer member CHL4 being uniformly charged is caused to be closely opposite to the surface of the switching layer SWL of the recording member RMsw on which a charge pattern corresponding to the electrostatic latent image originally in the charge hold layer member CHL1 of the first recording member RM1 is transferred to and registred. Furthermore, the electrode E7 on the recording member RMsw and the electrode E6 provided on the blank recording member RM4 are connected, to thereby form an electrostatic latent image corresponding to the registered state of the charge pattern in the switching layer SWL (FIG. 6C) on the charge hold layer CHL4, as the charges thereon opposing ON state portions of the switching layer SWL are discharged. Thus, upon removing the recording member RMsw the electrostatic latent image is transferred onto the charge hold layer member of the recording member RM4 (FIG. 6D).

For the switching layer SWL having a conductivity varying in dependency on an electric field, e.g., there is a Cu TCNQ (copper-tetracyanoquinodimethan) complex crystal film.

In FIG. 6A, the conductivity of the switching layer SWL in the recording member RMsw varies in correspondence with an electric field strength distribution corresponding to the charge distribution of the electrostatic latent image of the charge hold layer member CHL1 in the recording member RM1 disposed facing the switching layer SWL. In this figure, the portions labeled ON in the switching layer SWL of the recording member RMsw indicate low resistance portions in the switching layer SWL. On the other hand, the portions labeled OFF in the switching layer SWL indicate high resistance portions in the switching layer SWL (This applies to other embodiments in which a recording member including a switching layer SWL is used).

In FIG. 6A, the electrode E1 of the first recording member RM1 and the electrode E7 of the recording member RMsw are connected so that they have the common potential. Then, the charge pattern corresponding to the electrostatic latent image of the charge hold layer member CHL1 in the recording member RM1 on which an electrostatic latent image is formed is stored as a distribution pattern registering changes in resistance in the thickness direction of the switching layer SWL in the recording member RMsw (distribution pattern registering ON and OFF states of the switch). As an alternative, instead of making both of the electrodes E1 and E7 to the common potential, causing the resistance distribution pattern in the switching layer SWL may be carried out under the condition that the electrode E7 is biased to have a potential with respect to the electrode El, so that the charge pattern corresponding to the electrostatic latent image of the charge hold layer member CHL1 in the first recording member RM1 is stored as a distribution pattern registering changes in resistance of the switching layer SWL in the recording member RMsw (distribution pattern assuming ON and OFF states of the switch).

In the case of transferring, onto another recording member the recording member RMsw on which a charge pattern of the electrostatic latent image stored as a distribution pattern registering changes in resistance of the switching layer SWL in the recording member RMsw in a manner stated above is used as a master in the method described below may be employed. First, as shown in FIG. 6B, the surface of a charge hold layer member CHL4 of a blank recording member RM4 is uniformly charged preliminary, e.g., a corona charger CC is caused to be closely opposed to the surface of the switching layer SWL of the recording member RMsw. When the electrode E7 provided on the recording member RMsw and the electrode E6 provided on the blank recording member RM4 are connected, the charges on the charge hold layer member CHL4 of the recording member RM4 facing the portion where the switch is in an ON state (the portions of low resistance) in the switching layer SWL is neutralized. As a result, only charges facing the portions where the switch is in an OFF state (the portions of high resistance) in the switching layer SWL are left. Accordingly, an electrostatic latent image having a charge pattern corresponding to the electrostatic latent image of the charge hold layer member CHL1 in the first recording RM1 is transferred to the charge hold layer member CHL4 of the blank recording member RM4 as shown in FIG. 6D.

FIG. 7 is an explanatory view of the arrangement and the operation of a recording member RMa which is different in construction from the recording member RM in FIG. 1, but operates in place thereof in FIG. 1. As shown in FIG. 7, the recording member RMa is of a laminated structure comprising an electrode E, a switching layer SWL having a conductivity varying in dependency on an applied electric field (e.g., Cu TCNQ complex crystal film), and a photoconductive layer member PCLa which has a characteristic that it behaves as a dielectric layer when exposed to a light which is below a certain intensity, but it becomes photoconductive when exposed to a light of higher intensity.

In FIG. 1, the recording member RMa is disposed in place of the recording member RM in a manner that the exposed side of the photoconductive layer member PCLa confronts the photoconductive layer member PCL in the recording head ReH in the recording system shown in FIG. 1. When power supply Vb is connected between a transparent electrode Et on the recording head ReH and an electrode E on the recording member RMa, an electric field having a predetermined strength is applied between the transparent electrode Et of the recording head ReH and the electrode E of the recording member RMa. In this state, when opening/closing operation of the shutter is 5 conducted, an optical image of the object O is formed on the photoconductive layer member PCL in the recording head ReH. Thus, an electrostatic latent image (charge image) corresponding to the optical image of the object O is formed on the photoconductive layer member PCLa in the recording member RMa, as the photoconductive layer member PCLa behaves as a dielectric layer under this condition.

Figure 7A:
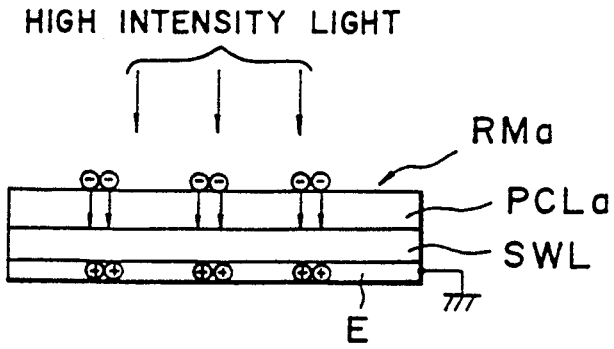
FIGS. 7A to 7D are explanatory views showing process steps of a still further embodiment according to this invention, respectively.

FIG. 7A is a diagram showing a further process in which a procedure is taken to uniformly irradiate a higher intensity light onto the entire surface of the photoconductive layer member PCLa, on which an electrostatic latent image corresponding to an optical image of an object O is formed. Because of the characteristic of the photoconductive layer member PCLa explained before, the uniform irradiation of the higher intensity light causes to lower the electric resistance of the photoconductive layer member PCLa allowing to move negative charges of the charge image formed thereon passing through the photoconductive layer member PCLa of the recording member RMa, thus to accumulate the negative charges at the boundary between the photoconductive layer member PCLa and the switching layer SWL of the recording member RMa.

Figure 7B:
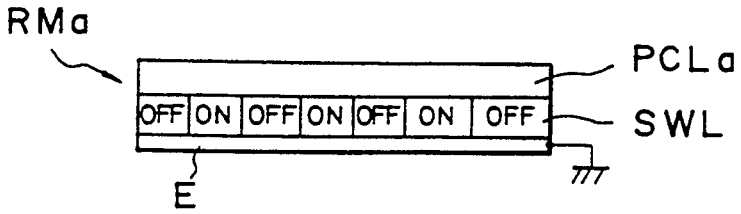

The accumulated negative charges at the boundary between the photoconductive layer member PCLa and the switching layer SWL of the recording member RMa, generate an electric field having a strength corresponding to a charge distribution of the electrostatic latent image mentioned before and the electric field is applied to the switching layer SWL. As a result, as illustrated in FIG. 7B, a distribution pattern registering variations in resistance (distribution pattern indicating ON and OFF states of the switch) is produced in correspondence with the charge distribution of the electrostatic latent image.

Figure 7C:
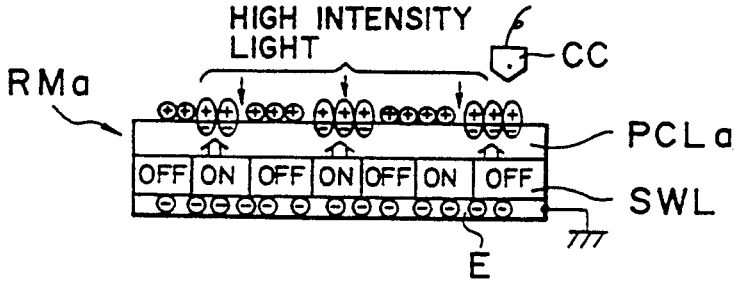

Then, as shown in FIG. 7C, a uniform layer of positive charges are applied to the surface of the photoconductive layer member PCLa of the recording member RMa by using, e.g., corona charger CC. Then the photoconductive layer member PCLa is uniformly irradiated again with the higher intensity light. This causes uniformly applied positive charges on the surface of the photoconductive layer member PCLa being locally neutralized by negative charges moved from the electrode E through the portions where the switch is in an ON state (the portions of low resistance) in the switching layer SWL. As a result, only charges corresponding to the portions where the switch is an OFF state (the portions of high resistance) in the switching layer SWL are left on the surface of the photoconductive layer member PCLa of the recording member RMa (FIG. 7D).

Figure 7D:
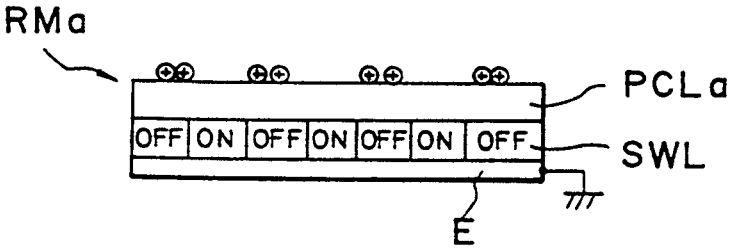

As shown in FIG. 7D, the electrostatic latent image formed on the surface of the photoconductive layer member PCLa of the recording member RMa may be transferred onto other recording members by various transfer means as previously described with reference to FIGS. 2 to 6. The recording member of a structure as shown in FIG. 7 stores, in the switching layer, information indicative of charge distribution in the electrostatic latent image. Thus, even if an electrostatic latent image on the surface of the photoconductive layer member PCLa of the recording member RMa is lost, it is possible to restore, on the switching layer SWL of the recording member RMa, an electrostatic latent image repeatedly as desired on the basis of the information of the charge distribution of the electrostatic latent image stored as a distribution of ON and OFF states of the switch by uniformly charging the surface of the photoconductive layer member PCLa of the recording member RMa using, e.g., a corona charger CC, etc., as shown in FIG. 7C.

The recording member RMa shown in FIG. 7 may take any form. Moreover, the information to be recorded onto the recording member RM shown in FIG. 1 and the recording member RMa shown in FIG. 6 may be any one of optical image, character, graphic and pattern, either an analog signal or a digital signal, or a combination of various types of information or signals.

In addition, the image transfer may be carried out at a time for the entire area of the image, or for a part thereof, or carried out continually or repeatedly of a part of the image.

We claim:

1. A method for non-destructively transferring an electrostatic latent image comprising the steps of:

preparing a master recording member one side of which is provided with a first electrode and another side of which is provided with a first recording layer in which an image information is preformed in a form of material characteristic change of the first recording layer;

preparing a blank recording member having a second recording layer;

disposing the first recording layer of the master recording member in a non-contact confronting position with respect to the second recording layer;

providing a uniform layer of charges to the second recording layer of the blank recording member by charge providing means on a side of the second recording layer opposite to the side confronting the preformed image information, to produce a transferred electrostatic latent image on the second recording layer of the blank recording member correspondingly with and in response to the image information preformed in the first recording layer of the master recording member;

said first and second recording layers being first and second charge hold layers, respectively, thus allowing the second charge hold layer to produce said transferred electrostatic latent image thereon in response to the provision of the uniform layer of charges to the second charge hold layer of the blank recording member;

said charge providing means comprising a stationary electrode contacting the second charge hold layer of the blank recording member, and a predetermined voltage source connected between the first and the stationary electrodes;

moving said first and blank recording members synchronously together with respect to the stationary electrode;

moving said first recording member away from said blank recording member after a position where said first recording member and said second blank recording member are interposed between said first and stationary electrodes;

attaching a second electrode to said second charge hold layer of the blank recording member at a side thereon opposite to the side contacted with the stationary electrode.

2. A method for non-destructively transferring an electrostatic latent image comprising the steps of:

preparing a master recording member one side of which is provided with a first electrode and another side of which is provided with a first recording layer in which an image information is preformed in a form of material characteristic change of the first recording layer;

preparing a blank recording member having a second recording layer;

disposing the first recording layer of the master recording member in a non-contact confronting position with respect to the second recording layer; and providing a uniform layer of charges to the second recording layer of the blank recording member by charge providing means on a side of the second recording layer opposite to the side confronting the preformed image information, to produce a transferred electrostatic latent image on the second recording layer of the blank recording member correspondingly with and in response to the image information preformed in the first recording layer of the master recording member;

said first and second recording layers being first and second charge hold layers, respectively, thus allowing the second charge hold layer to produce said transferred electrostatic latent image thereon in response to the provision of the uniform layer of charges to the second charge hold layer of the blank recording member;

said charge providing means comprising a corona charger confronting the second charge hold layer of the blank recording member; and moving said first and blank recording members synchronously together with respect to the corona charger.

3. A method for non-destructively transferring an electrostatic latent image comprising the steps of:

preparing a master recording member one side of which is provided with a first electrode and another side of which is provided with a first recording layer in which an image information is preformed in a form of material characteristic change of the first recording layer;

preparing a blank recording member having a second recording layer;

disposing the first recording layer of the master recording member in a non-contact confronting position with respect to the second recording layer;

providing a uniform layer of charges to the second recording layer of the blank recording member by charge providing means on a side of the second recording layer opposite to the side confronting electrostatic latent image on the second recording layer of the blank recording member correspondingly with and in response to the image information preformed in the first recording layer of the master recording member;

said first and second recording layers being first and second charge hold layers, respectively, thus allowing the second charge hold layer to produce said transferred electrostatic latent image thereon in response to the provision of the uniform layer of charges to the second charge hold layer of the blank recording member;

said second charge hold layer being composed of a threshold layer having a threshold voltage for passing therethrough charges having potentials above said threshold voltage and a layer laminated to the threshold layer for holding charges passed through the threshold layer, and said charge providing means comprising a second electrode laminated to said threshold layer and a predetermined voltage source connected to said first and second electrodes generating the predetermined voltage equal to said threshold voltage.

4. A method as claimed in claim 3, wherein said threshold layer is a silicon oxide film and said layer for holding charges is a silicon nitride film.

5. A method for non-destructively transferring an electrostatic latent image comprising the steps of:

preparing a master recording member one side of which is provided with a first electrode and another side of which is provided with a first recording layer in which an image information is preformed in a form of material characteristic change of the first recording layer;

preparing a blank recording member having a second recording layer;

disposing the first recording layer of the master recording member in a non-contact confronting position with respect to the second recording layer;

providing a uniform layer of charges to the second recording layer of the blank recording member by charge providing means on a side of the second recording layer opposite to the side confronting the preformed imaging information, to produce a transferred electrostatic latent image on the second recording layer of the blank recording member correspondingly with and in response to the image information preformed in the first recording layer of the master recording member;

said first recording layer comprising a thermoplastic material deformable in response to heat and an electric field applied thereto; and preforming said image information in the first recording layer in a form of deformation thereof, said charge providing means comprising a second electrode laminated to the second recording member and a predetermined voltage source connected to said first and second electrode.

6. A method for non-destructively transferring an electrostatic latent image comprising the steps of:

preparing a master recording member one side of which is provided with a first electrode and another side of which is provided with a first recording layer in which an image information is preformed in a form of material characteristic change of the first recording layer;

preparing a blank recording member having a second recording layer;

disposing the first recording layer of the master recording member in a non-contact confronting position with respect to the second recording layer; and providing a uniform layer of charges to the second recording layer of the blank recording member by charge providing means on a side of the second recording layer opposite to the side confronting the preformed imaging information, to produce a transferred electrostatic latent image on the second recording layer of the blank recording member correspondingly with and in response to the image information preformed in the first recording layer of the master recording member;

said first recording layer comprising a material of which conductivity is variable in response to an electrical field applied thereto;

preforming said image information in the first recording layer in a variation of electroconductivity; and preparing said blank recording member so that one side of said second recording layer is laminated to a second electrode as the charge providing means, and other side of said second recording layer is provided with a uniform layer of charges, and said charge providing means further comprises means for making said first and second electrodes to a common potential.

7. A method as claimed in claim 6, wherein said material of variable conductivity is copper tetracyanoquinodimenthan complex crystal.

8. A method as claimed in claim 1, and further comprising:

after said step of preparing a blank recording member, repeating said disposing step and said providing step.

9. A method as claimed in claim 2, and further comprising: after said step of preparing a blank recording member, repeating said disposing step and said providing step.

10. A method as claimed in claim 3, and further comprising: after said step of preparing a blank recording member, repeating said disposing step and said providing step.

11. A method a claimed in claim 5, and further comprising: after said step of preparing a blank recording member, repeating said disposing step and said providing step.

12. A method as claimed in claim 6, and further comprising: after said step of preparing a blank recording member, repeating said disposing step and said providing step.

13. A method of producing a master recording member comprising:

a) preparing a recording member having a laminated structure comprising a switching layer having electroconductivity variable in response to an applied electric field, an electrode laminated to one side of the switching layer, a photoconductive layer laminated to other side of the switching layer, the photoconductive layer behaving as a dielectric layer when exposed to a first level of light and becoming a photoconductive layer when exposed to a second level of light which is higher in intensity than the first level of light;

b) forming an electrostatic latent image on an exposed side of the photoconductive layer, which is opposite to a side facing the switching layer;

c) exposing said exposed side of the photoconductive layer uniformly to said second level of light so that charges of the formed electrostatic latent image pass through the photoconductive layer and accumulate between the photoconductive layer and the switching layer causing said switching layer to generate a pattern of resistance variation corresponding to the electrostatic latent image formed on the exposed side of the photoconductive layer;

d) providing a uniform layer of charges to the exposed side of the photoconductive layer by charge providing means; and e) exposing said exposed side of the photoconductive layer uniformly to said second level of light so that the charges uniformly provided to the exposed side of the photoconductive layer are subject to neutrarization depending on said pattern of resistance variation corresponding to the electrostatic latent image resulting in a newly formed electrostatic latent image left on the exposed side of the photoconductive layer.

14. A system for non-destructively transferring an electrostatic latent image from a master recording member to a blank recording member comprising:

a master recording member one side of which is provided with a first electrode and another side of which is provided with a first recording layer in which an image information is preformed in a form of material characteristic change of the first recording layer;

a blank recording member having a second recording layer non-contacting confronting relationship to said first recording layer of the master recording member;

charge providing means for providing a uniform layer of charges to the second recording layer of the blank recording member on a side of the second recording layer opposite to the side thereof confronting the preformed image information to produce a transferred electrostatic latent image on the second recording layer of the blank recording member correspondingly with and in response to the image information preformed in the first recording layer of the master recording member;

said first and second recording layers being first and second charge hold layers, respectively, thus allowing the second charge hold layer to produce said transferred electrostatic latent image thereon in response to the provision of the uniform layer of charges to the second charge hold layer of the blank recording member;

said charge providing means comprising a stationary second electrode contacting the second charge hold layer of the blank recording member and a predetermined voltage source connected between the first and the stationary second electrodes, and said first and blank recording members being synchronously movable together with respect to the stationary electrode;

said first recording member being movable away from said blank recording member after a position where said first recording member and said second blank recording member are interposed between said first and stationary second electrodes; and a third electrode attached to said second charge hold layer of the blank recording member at an opposite side thereof to the side contacted with the stationary electrode.

15. A system for non-destructively transferring an electrostatic latent image from a master recording member to a blank recording member comprising:

a master recording member one side of which is provided with a first electrode and another side of which is provided with a first recording layer in which an image information is preformed in a form of material characteristic change of the first recording layer;

a blank recording member having a second recording layer in non-contacting confronting relationship to said first recording layer of the master recording member;

charge providing means for providing a uniform layer of charges to the second recording layer of the blank recording member on a side of the second recording layer opposite to the side thereof confronting the preformed image information to produce a transferred electrostatic latent image on the second recording layer of the blank recording member corresponding with and in response to the image information preformed in the first recording layer of the master recording member;

said first and second recording layers being first and second charge hold layers, respectively, thus allowing the second charge hold layer to produce said transferred electrostatic latent image thereon in response to the provision of the uniform layer of charges to the second charge hold layer of the blank recording member; and said charge providing means comprising a corona charger confronting the second charge hold layer of the blank recording member, said first and blank recording members being synchronously movable together with respect to the corona charger.

16. A system for non-destructively transferring an electrostatic latent image from a master recording member to a blank recording member comprising:

a master recording member one side of which is provided with a first electrode and another side of which is provided with a first recording layer in which an image information is preformed in a form of material characteristic change of the first recording layer;

a blank recording member having a second recording layer in non-contacting confronting relationship to said first recording layer of the master recording member;

charge providing means for providing a uniform layer of charges to the second recording layer of the blank recording member on a side of the second recording layer opposite to the side thereof confronting the preformed image information to produce a transferred electrostatic latent image on the second recording layer of the blank recording member correspondingly with and in response to the image information preformed in the first recording layer of the master recording member;

said first and second recording layers being first and second charge hold layers, respectively, thus allowing the second charge hold layer to produce said transferred electrostatic latent image thereon in response to the provision of the uniform layer of charges to the second charge hold layer of the blank recording member;

said second charge hold layer comprising a threshold layer having a threshold voltage for passing therethrough charges having potentials above said threshold voltage and a layer laminated to the threshold layer for holding charges passed through the threshold layer; and said charge providing means comprising a second electrode laminated to said threshold layer and a predetermined voltage source connected to said first and second electrode for generating the predetermined voltage equal to said threshold voltage.

17. A system for transferring an electrostatic latent image as claimed in claim 16, wherein:

said threshold layer is a silicon oxide film; and said layer for holding charges is a silicon nitride film.

18. A system for non-destructively transferring an electrostatic latent image from a master recording member to a blank recording member comprising:

a master recording member one side of which is provided with a first electrode and another side of which is provided with a first recording layer in which an image information is preformed in a form of material characteristic change of the first recording layer;

a blank recording member having a second recording layer in non-contacting confronting relationship to said first recording layer of the master recording member;

charge providing means for providing a uniform layer of charges to the second recording layer of the blank recording member on a side of the second recording layer opposite to the side thereof confronting the preformed image information to produce a transferred electrostatic latent image on the second recording layer of the blank recording member correspondingly with and in response to the image information preformed in the first recording layer of the master recording member;

said first recording layer comprising a thermoplastic material deformable in response to heat and an electric field applied thereto, said image information being preformed in the first recording layer in a form of deformation thereof; and said charge providing means comprises a second electrode laminated to the second recording member and a predetermined voltage source connected to said first and second electrodes.

19. A system for non-destructively transferring an electrostatic latent image from a master recording member to a blank recording member comprising:

a master recording member one side of which is provided with a first electrode and another side of which is provided with a first recording layer in which an image information is preformed in a form or material characteristic change of the first recording layer;

a blank recording member having a second recording layer in non-contacting confronting relationship to said first recording layer of the master recording member;

charge providing means for providing a uniform layer of charges to the second recording layer of the blank recording member on a side of the second recording layer opposite to the side thereof confronting the preformed image information to produce a transferred electrostatic latent image on the second recording layer of the blank recording member correspondingly with and in response to the image information preformed in the first recording layer of the master recording member;

said first recording layer comprising a material of which conductivity is variable in response to an electrical field applied thereto, said image information being preformed in the first recording layer in a variation of electroconductivity;

said blank recording member being prepared so that one side of said second recording layer is laminated to a second electrode as the charge providing means, the other side of said recording layer being provided with a uniform layer of charges; and said charge providing means further comprising means for making said first and second electrodes to a common potential.

20. A system for transferring an electrostatic latent image as claimed in claim 19, wherein:

said material of variable conductivity is coppertetracyanoquinodimethan complex crystal.

21. A system for transferring an electrostatic latent image as claimed in claim 14, wherein:

said transferring is repeatedly performable.

22. A system for transferring an electrostatic latent image as claimed in claim 13, wherein:

said transferring is repeatedly performable.

23. A system for transferring an electrostatic latent image as claimed in claim 16, wherein:

said transferring is repeatedly performable.

24. A system for transferring an electrostatic latent image as claimed in claim 18, wherein:

said transferring is repeatedly performable.

25. A system for transferring an electrostatic latent image as claimed in claim 19, wherein:

said transferring is repeatedly performable.

* * * * *